United States Patent [19]

Fleischer

[11] Patent Number: 4,636,426

[45] Date of Patent: Jan. 13, 1987

[54] PAPERMAKER'S FABRIC WITH YARNS HAVING MULTIPLE PARALLEL MONOFILAMENT STRANDS

[75] Inventor: Thomas B. Fleischer, Raleigh, N.C.

[73] Assignee: Huyck Corporation, Wake Forest, N.C.

[21] Appl. No.: 688,900

[22] Filed: Jan. 4, 1985

[51] Int. Cl.[4] ..... D03D 3/00

[52] U.S. Cl. ..... 428/224; 139/425 A; 162/DIG. 1; 428/225; 428/232; 428/257; 428/374

[58] Field of Search ..... 428/221, 224, 225, 232, 428/374, 257, 258, 259, 292, 293, 294, 295; 139/425 A; 162/DIG. 1

[56] References Cited

U.S. PATENT DOCUMENTS

| | | | |
|---|---|---|---|
| 2,088,447 | 7/1937 | Specht | 139/425 A |
| 3,167,281 | 1/1965 | Hill | 139/425 A |
| 4,533,594 | 8/1985 | Buchanan | 428/259 |

*Primary Examiner*—James J. Bell

*Attorney, Agent, or Firm*—Pahl, Lorusso & Loud

[57] ABSTRACT

Disclosed is a papermaker's forming fabric which is produced from yarns including at least two parallel monofilament strands. Such yarns may be utilized exclusively in the cross-machine direction, or they may be utilized in both the machine and cross-machine directions. Such a fabric construction results in reduced knuckles thereby providing a fabric displaying improved sheet-release and reduced wire mark.

20 Claims, 7 Drawing Figures

PAPERMAKER'S FABRIC WITH YARNS HAVING MULTIPLE PARALLEL MONOFILAMENT STRANDS

BACKROUND OF THE INVENTION

The present invention relates to papermaker's forming fabrics and in particular to a papermaker's forming fabric in which the yarns of the fabric include at least two parallel strands which are positioned in a side by side relationship in a plane parallel to the plane of the fabric.

Conventional forming fabrics or fourdrinier wires for use in papermaking machines usually are in the form of a fine mesh cloth which has been woven endless or otherwise joined into an endless web. A layer of wet pulp is deposited on the forming side of the papermaker's fabric and water is withdrawn from the pulp through the fabric by vacuum means or the like located on the machine side of the fabric. Since the very basis of good quality paper resides in the web formation from the wet pulp, the structure of the forming fabric is of vital and decisive importance.

At one time, all forming fabrics were manufactured from metal wires. These metal wire cloths were useful in all kinds of papermaking machines and for all paper qualities. Eventually, metal wire cloths were replaced by single layer cloths of wires of synthetic fiber threads. Whether the forming fabrics were made from synthetic wires or bronze wires, the forming fabrics were produced by weaving single cylindrical monofilament strands of metal or stretch resistant polymer material together according to known single or multi-ply fabric constructions.

When woven according to known fabric constructions, such bronze wires or synthetic fibers will impart a mark in the formed sheet corresponding to the size and shape of a cylindrical yarn knuckle 4 (see FIG. 3) protruding into the paper mat surface. These knuckles cause a reduction in the smoothness of the formed paper and thus reduce the utility of the paper as a printing surface.

Numerous attempts to reduce the wire mark caused by the knuckles 4 of the forming fabrics 2 have failed. Such attempts include producing a wire mesh fabric from smaller diameter yarns. Another approach has involved reducing the knuckle heights in the fabric by sanding the sheet side of the fabric. The problem with both of these methods, however, is that the strength and durability of the fabrics are reduced.

Another problem caused by the knuckles in the forming fabric is that forming fabrics produced from cylindrical yarns 6, 8 generally show poor sheet release from the fabric. This weakens the fiber mat and leaves fibers or fiber bundles in the fabric as well as a non-smooth paper surface on the machine side of the fabric. It was thought that this problem would be alleviated by introducing yarns with flat or rectangular cross sections in the warp direction, and such attempts are taught by U.S. Pat. No. 3,139,119 issued to W. E. Buchanan and by U.S. Pat. No. 4,142,557 issued to Kozitky. Fabrics made according to the Buchanan or Kozitky patents have not, however, found general acceptance in the marketplace, probably because the cylindrical cross machine direction knuckles still produce adverse wire marks and release problems. Also, due to the nature of the weaving process, a fabric with a flat filling yarn cannot be woven with satisfactory uniformity as the filling yarn tends to twist in the fabric as it is unwound from the bobbin.

It is therefore a principal object of the present invention to provide a papermaker's forming fabric displaying improved sheet release and reduced wire mark.

It is a further object of the present invention to reduce the knuckle height of the yarns in a forming fabric.

Still another object of the present invention is to reduce wire mark without introducing yarns with a flat or rectangular cross section in the warp direction.

Yet another object of the present invention is to provide a forming fabric with reduced knuckle height which can be either a single layer or a multi-layer fabric.

SUMMARY OF THE INVENTION

The papermaker's forming fabric of the present invention, which displays improved wire mark and sheet release characteristics is woven from yarns which are comprised of two or more parallel monofilament strands which are positioned in a side by side relationship. These parallel monofilament strands are located in a plane parallel to the plane of the fabric, and they may be made from polyethylene terephtalate, nylon, polypropylene, or other similar materials.

Preferably, the fabric is treated with a polymer material to glue the parallel strands of the yarns together along their entire length. This polymer material should be a hydrophylic water absorbent polyester which has a lower melting point than the polymer of which the monofilament strands are made. This lower melting temperature allows the gluing together of the yarns as well as the welding together of cross machine and machine direction yarns at the cross-overs.

These and other features of the present invention will be more fully understood from the following detailed description which should be read in light of the accompanying drawings.

DETAILED DESCRIPTION OF THE PREFERRED EMBODIMENTS

Figure 1:
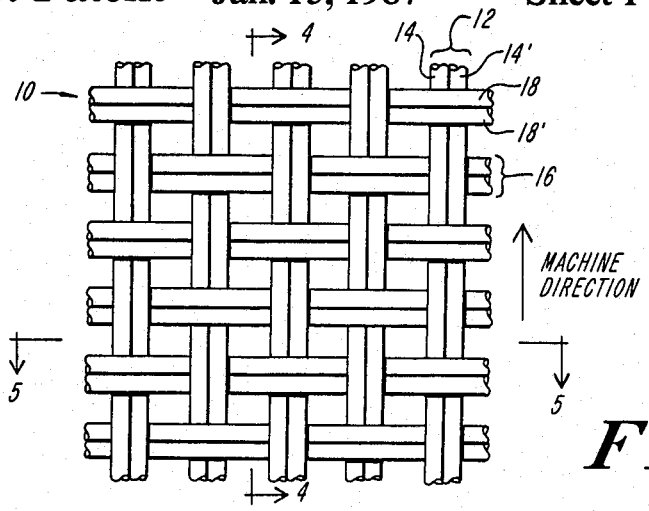
FIG. 1 is a fragmentary plan view of a fabric made according to the present invention with two parallel strands in each yarn in both the machine direction and the cross-machine direction.

In the embodiment of the papermaker's fabric of the present invention shown in FIG. 1, each machine direction yarn 12 of the fabric 10 includes two parallel, monofilament, cylindrical strands 14, 14' which are positioned in a side by side relationship. The cross-machine direction yarns 16 of the fabric 10 also include two parallel, monofilament, cylindrical strands 18, 18' positioned in a side by side relationship.

The strands which make up the yarns 12, 16 may be produced from polyethelene terephtalate, nylon, polypropylene or other similar materials commonly used to make papermaker's fabrics. Preferably, the forming fabric is treated with a polymer material in order to secure together the two parallel strands of both the cross-machine direction yarns and the machine direction yarns along the entire length of the strands. The polymer material used in treating the strands is preferably a hydrophylic water absorbent polyester. In addition, this treating polymer should have a lower melting point than the polyester monofilament strands so that, when subjected to a heat treatment, the two strands may be "glued together" along side faces, and the cross-machine direction and machine direction yarns can be welded together at the cross-overs.

Figure 2:
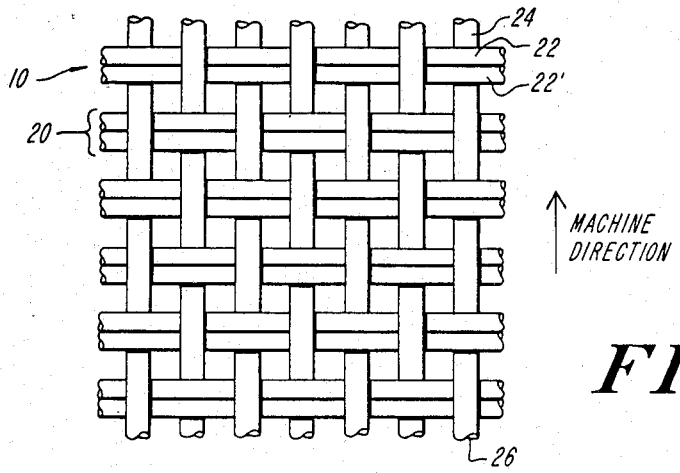
FIG. 2 is a fragmentary plan view of another embodiment of the fabric according to the present invention in which two parallel strands make up each yarn of the cross machine direction and one cylindrical yarn is laid in the machine direction.
Figure 3:
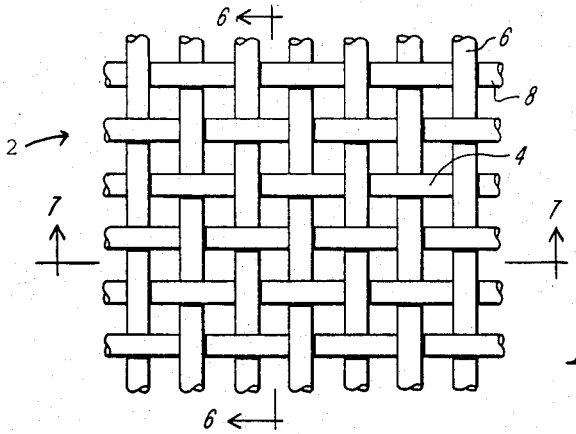
FIG. 3 (PRIOR ART)
FIG. 3 is a fragmentary plan view of a prior art fabric with the same weave configuration as that utilized in FIGS. 1 and 2.
Figure 4:
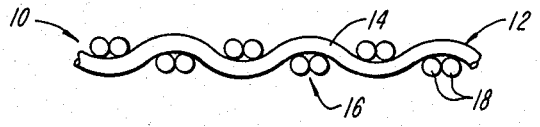
FIG. 4 shows a cross-sectional view of the fabric of FIG. 1 taken along lines 4—4.
Figure 5:
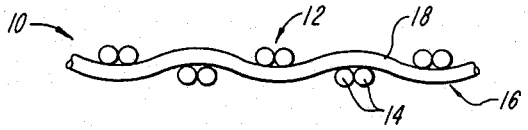
FIG. 5 is a cross-sectional view of the fabric of FIG. 1 taken along lines 5—5.
Figure 6:
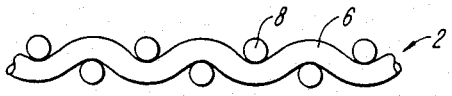
FIG. 6 (PRIOR ART)
FIG. 6 shows a cross-sectional view of the prior art fabric shown in FIG. 3 taken along lines 6—6.
Figure 7:
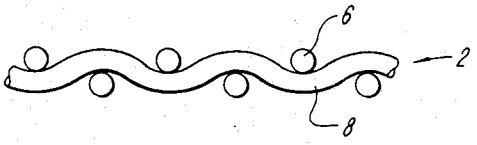
FIG. 7 (PRIOR ART)
FIG. 7 is a cross-sectional view of the prior art fabric of FIG. 3 taken along lines 7—7.

In the embodiment of FIG. 2, each cross-machine direction yarn 20 includes two parallel strands 22, 22' which are positioned in a side by side relationship. In the machine direction, a single cylindrcal strand 24 is employed.

In general, fabrics produced according to the present invention will possess a smooth sheet side surface. Also, fabrics incorporating multiple, parallel strand yarns may be woven in conventional single layer or multi-layer weave patterns such as 2/1 twill, plain weave, 2/2 twill, etc. where each yarn in the warp and/or filling consists of two or more monofilament, cylindrical strands running side by side in a parallel fashion where the two or more filaments reside in a plane substantially parallel to the sheet surface. A fabric produced according to the teachings of the present invention with two parallel strands in each machine direction yarn and two parallel strands in each cross-machine direction yarn (as shown in FIG. 1) will have a knuckle height of approximately 50% of the knuckle height of prior art fabrics produced from cylindrical yarns in the same mesh and having the same open area as the fabric made according to the present invention. A fabric produced according to the teachings of the present invention with two parallel strands in each cross-machine direction yarn and one strand in each machine direction yarn will have a knuckle height of approximately 50% of the knuckles height of fabrics which are produced from cylindrical yarns and which have the same mesh and open area as a fabric manufactured according to the present invention.

Many other features and aspects of the present invention will become apparent from the following non-limiting examples.

EXAMPLE 1

A forming fabric was woven from a cross-machine direction yarn comprising two 0.38 mm cylindrical monofilament strands made from polyethalene terephtalate and a machine direction yarn comprising two 0.36 mm cylindrical monofilament strands made from the same material. The samples were woven in a plain weave 18×17 mesh, and they had an air permeability of 771 cfm. The samples also had an open area of 24%, stretch resistance in the machine direction of 44,100 denier per inch and a caliper of 0.035 inches. A corresponding prior art fabric woven in the plain weave with a mesh of 18×17 and an open area of 24% would have a caliper of 0.070 inches and a stretch resistence of 88,100 denier per inch.

EXAMPLE 2

A forming fabric according to the present invention and shown in FIG. 2 was woven endless in a production loom using a cross-machine direction yarn comprising two 0.38 mm strands made from polyester and a machine direction yarn comprising one polyester strand of 0.50 mm. The fabric was treated with a 1% aqueous dispersion of hydrophylic polyethylene terephtate polyester resin Milease HPA from ICI American by passing the fabric over a roll applicator. After drying and curing at 250° F., the fabric was heat treated at constant length at 380° F. The treatment bonded or glued the parallel multiple strands together and at the same time glued the machine direction yarn to the cross machine direction yarns at the crossovers, producing a stiff, stable fabric with a firm hand. The resulting forming fabric had a 24% open area, a mesh count of 18×24 and a stretch resistance in the machine direction of 62,500 denier per inch. The resulting caliper was 0.035 inches. A corresponding caliper of a prior art fabric of the same construction using 0.76 mm and 0.50 mm cylindrical yarns would have a caliper of 0.050 and a stretch resistance 62,500 denier per inch.

As can be seen from the above examples as well as from the detailed description of the preferred embodiments, a forming fabric produced according to the present invention will produce a paper surface having less wire mark. In addition, such a forming fabric will have a smoother surface which results in better release of the formed web. Moreover, the fabric according to the present invention will have smaller void volumes thereby carrying less water into the couch which results in the production of a dryer and stronger sheet at the couch.

While the foregoing invention has been described with reference to its preferred embodiments, and a number of non-limiting examples, variations and modifications will occur to those skilled in the art. For example, yarns utilized in either the cross-machine or machine direction could comprise three or more cylindrical, monofilament strands. Also, while this invention has been described with reference to a single layer forming fabric, multi-layer forming fabrics can be constructed in which yarns of one or more layers include multiple parallel strands. It is intended that such variations and modifications fall within the scope of the appended claims.

What is claimed is:

1. A yarn for use in a papermaker's forming fabric comprising at least two monofilament strands arranged to be in a side by side parallel relationship said monofilament strands being made from a synthetic polymer, said strands being treated with a polymer material to secure said parallel strands of said yarn together along the entire length of said strands.

2. The yarn for use in a papermaker's forming fabric of claim 1 wherein said monofilament strands are made from polyethylene terephtalate.

3. The yarn for use in a papermaker's forming fabric of claim 1 wherein said monofilament strands are nylon strands.

4. The yarn for use in a papermaker's forming fabric of claim 1 wherein said monofilament strands are polypropylene strands.

5. The yarn for use in a papermaker's forming fabric of claim 1 wherein said polymer material is a hydrophilic water absorbant polyester.

6. The yarn for use in a papermaker's forming fabric of claim 1 wherein said polymer material has a lower melting temperature than the monofilament strands.

7. A papermaker's forming fabric having machine and cross-machine direction yarns comprising:

cross-machine direction yarns comprised of at least two monofilament strands arranged in a side by side relationship, parallel to the plane of the fabric said yarn being made from a synthetic polymer said parallel strands secured along their entire length.

8. A papermaker's forming fabric having machine and cross-machine direction yarns comprising cross-machine direction yarns comprised of at least two monofilament strands arranged in a side by side, parallel relationship, said strands being substantially located in a plane parallel to the plane of the fabric said strands of cross-machine direction yarns being treated with a polymer material to secure the parallel strands together along the entire length of said strands; and machine direction yarns comprised of at least two monofilament strands arranged in a side by side, parallel relationship, said strands being substantially located in a plane parallel to the plane of the fabric said strands of said machine direction yarns being treated with a polymer material to secure the parallel strands together along the entire length of said strands.

9. A papermaker's forming fabric of claim 7 wherein the machine direction yarns comprise a single monofilament strand.

10. A papermaker's forming fabric of claim 7 wherein said monofilament strands are made from polyethylene terephtalate.

11. The forming fabric according to claim 7 wherein said monofilament strands are nylon strands.

12. The papermaker's forming fabric of claim 7 wherein said monofilament strands are polypropylene strands.

13. The papermaker's forming fabric of claim 7 wherein said polymer material is a hydrofilic water absorbant polyester.

14. A papermaker's forming fabric according to claim 7 wherein said polymer material has a lower melting temperature than said monofilament strands.

15. The forming fabric according to claim 7 wherein said forming fabric is subjected to a heat treatment which causes cross machine direction yarns to be secured to machine direction yarns at the cross overs and which causes two adjacent strands to be adhered together at side faces along their length.

16. The papermaker's forming fabric of claim 7 wherein said fabric is at least one layer of a multi-layer fabric.

17. The papermaker's forming fabric according to claim 8 wherein said polymer material is a hydrophilic water absorbant polyester.

18. The papermaker's forming fabric according to claim 8 wherein said polymer material has a lower melting temperature than said monofilament strands.

19. The forming fabric according to claim 8 wherein said forming fabric is subjected to a heat treatment which causes the cross-machine direction yarns to be secured to the machine direction yarns at the cross-overs and which causes two adjacent strands to be adhered together at side faces along their entire length.

20. The papermaker's forming fabric of claim 8 wherein said fabric is at least one layer of a multi-layer fabric.

* * * * *